United States Patent [19]

Nielsen, Jr. et al.

[11] 3,968,985

[45] July 13, 1976

[54] LOCKS FOR ELECTRIC METER BOXES

[76] Inventors: Anker J. Nielsen, Jr., 410 Bailey Road, R.F.D. 114, Holden, Mass. 01520; Lynn H. Morse, Box 1505, W. Venice Ave., Venice, Fla. 33595

[22] Filed: Apr. 9, 1975

[21] Appl. No.: 566,181

[52] U.S. Cl. ..... 292/340; 49/503; 70/63; 70/77; 70/78; 70/371

[51] Int. Cl.[2] ..... E05B 15/02

[58] Field of Search ..... 292/340; 70/63, 78, 70/34, 158, 371, 77, 81, 85, 386; 151/41.75; 49/503; 312/193; 220/10; 85/5 R, 5 B; 24/211 R, 211 N, 211 P

[56] References Cited

UNITED STATES PATENTS

| | | | |
|---|---|---|---|
| 1,321,514 | 11/1919 | Erickson | 292/340 X |
| 2,130,399 | 9/1938 | Rypinski | 292/340 |
| 2,395,377 | 2/1946 | MacLean, Jr. | 85/1 K |
| 2,558,720 | 7/1951 | Hansman | 151/41.75 |
| 2,668,729 | 2/1954 | Watters | 292/340 X |
| 2,804,116 | 8/1957 | Van Niel et al. | 151/41.75 X |
| 2,883,228 | 4/1959 | Roberts, Jr. | 151/41.75 X |
| 3,426,816 | 2/1969 | McIntire, Jr. et al. | 85/5 R X |
| 3,714,802 | 2/1973 | Morse et al. | 70/34 |
| 3,820,283 | 6/1974 | Acerra | 70/34 X |

FOREIGN PATENTS OR APPLICATIONS

| | | | |
|---|---|---|---|
| 370,006 | 2/1923 | Germany | 70/34 |

*Primary Examiner*—Roy D. Frazier
*Assistant Examiner*—William E. Lyddane
*Attorney, Agent, or Firm*—Robert K. Randall

[57] ABSTRACT

A locking adaptor assembly for a hollow meter box having a cover. A supporting element having an annular retaining shoulder is clipped to the flange of the box. A conventional bolt type lock is inserted through an aligned hole in the cover and through the supporting element where it is held in place to lock the cover firmly to the box.

9 Claims, 22 Drawing Figures

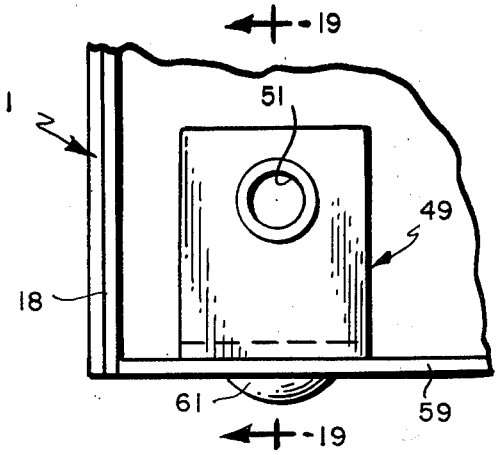
FIG.18
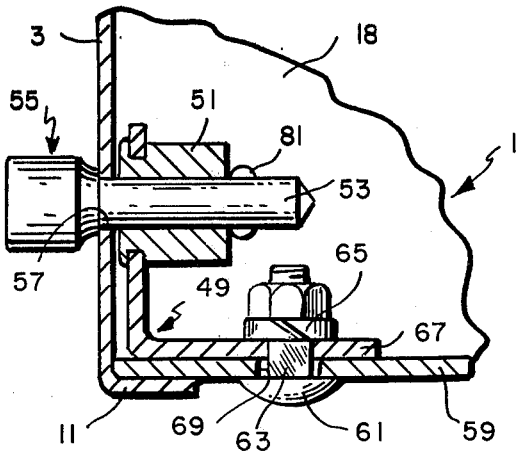
FIG.19
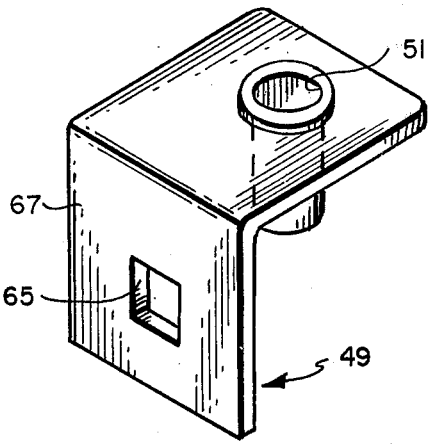
FIG.17
FIG.16
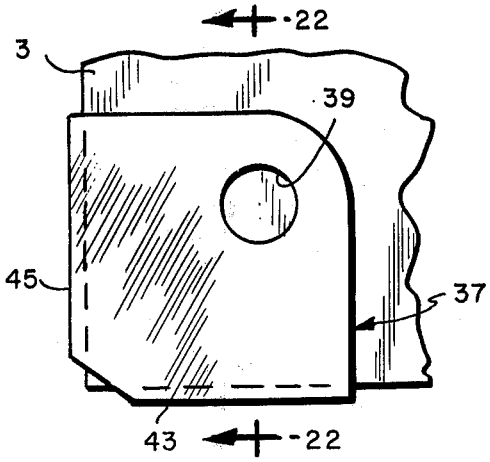
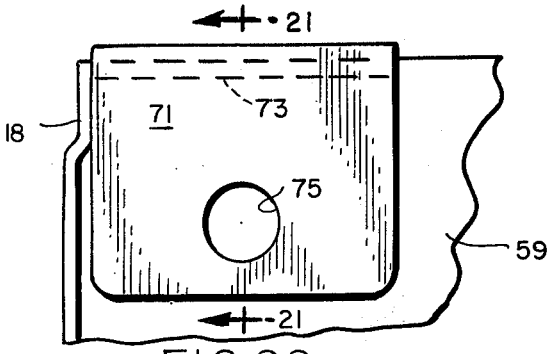
FIG.20
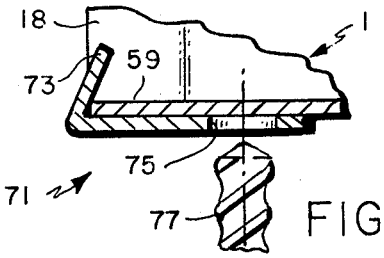
FIG.21
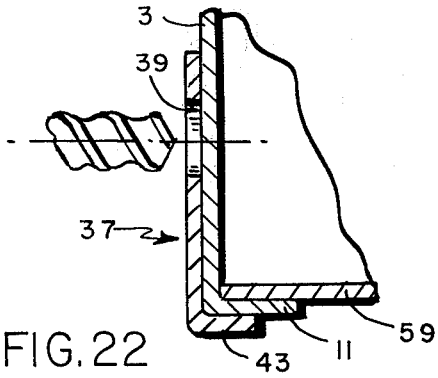
FIG.22

LOCKS FOR ELECTRIC METER BOXES

This invention provides a method and means for adapting the widely employed bolt type lock for use in securing the covers of meter boxes, already installed and in service, thereby conferring on them the proven protection against tampering with the meter and theft of current which this type of lock affords through its well-known resistance to picking or breaking. The conventional lead seal or miniature padlock put through the latch of the standard meter box, a moral deterrent at best, has proved far inadequate to check widespread pilfering of electrical current by tampering with the connections in the meter box.

In accordance with the invention, a supporting element bracket or clip having a sleeve or other annular retaining shoulder mating with the barrel of the bolt type lock is attached to the body of the meter box, and a hole is punched in the cover of the box to register with the sleeve to admit the barrel but arrest the head of the lock. Extension of the lateral locking elements of the barrel beyond the sleeve or other annular retaining shoulder prevents withdrawal of the lock and opening of the cover.

Illustrative embodiments of the invention are shown in the accompanying drawings, in which:

FIG. 1 is an elevation of the standard meter box, the works and usual pendent seal being omitted, and the cover closed, the box being in its usual vertical relation as mounted on a wall. FIG. 2 shows the lower end of the box with the cover removed. FIGS. 3, 4 and 5 show a novel supporting element clip having a guide sleeve which receives the barrel of the locking bolt, in front, bottom and end views, respectively.

FIGS. 15 and 16 show in vertical section and in elevation respectively the use of the template of FIG. 14 in locating the hole in the cover when the clip is used off-center as in FIG. 13.

FIG. 17 shows a bracket which replaces the clip when the meter box is of the type lacking an inturned flange.

FIG. 18 shows the bracket as installed in the lower left-hand corner of the box.

FIG. 19 shows in vertical section the use of the bracket in locking the cover.

FIG. 20 shows the template used to locate the bolt hole for mounting the bracket on the bottom wall of the box as in FIGS. 18 and 19.

FIG. 21 is a vertical section on line 21—21 of FIG. 20.

FIG. 22 is a vertical section on line 22—22 of FIG. 16.

Figure 7:
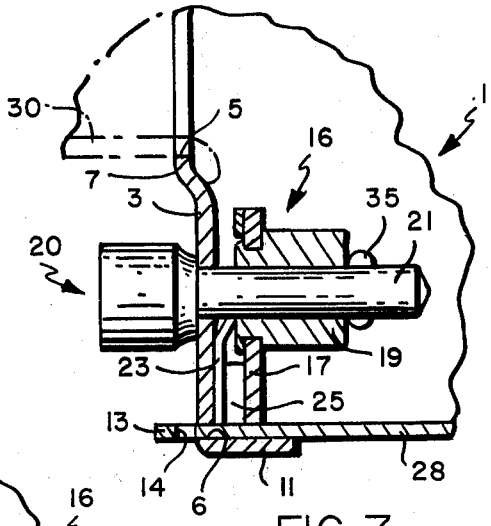
FIG. 7 is a section on line 7–7 of FIG. 6, with the cover added and closed and the locking bolt in place through the cover and the sleeve of the clip of FIG. 3.
Figure 8:
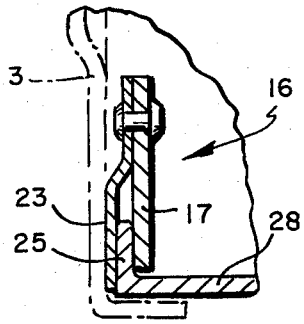
FIG. 8 is a section on line 8—8 of FIG. 6, with the position of the cover indicated in dot and dash lines.

The meter box 1 is of usual rectangular type, having a cover 3 with a circular central aperture 5 for the glass bowl indicated at 30 enclosing the meter works (not shown) and secured in place by the flange 7, FIG. 7, overlapping a matching flange on the bowl. The box is customarily permanently affixed in vertical relation on a wall or other suitable support. The upper end of the cover 3 is flanged outwardly and overlain by a flange 9 on the rim of the box. Three sides of the cover 3 have flanges 11 to overlie the side and lower edges of the box, the bend of the bottom flange being slotted at 6, at mid-width to receive a tongue 13 on the box's lower edge which tongue is itself slotted at 14, FIG. 7, to receive a latch or keeper 15 pivoted on the cover and formed with apertures for the reception of the familiar pendent lead seal (not shown), all as usual.

Figure 1:
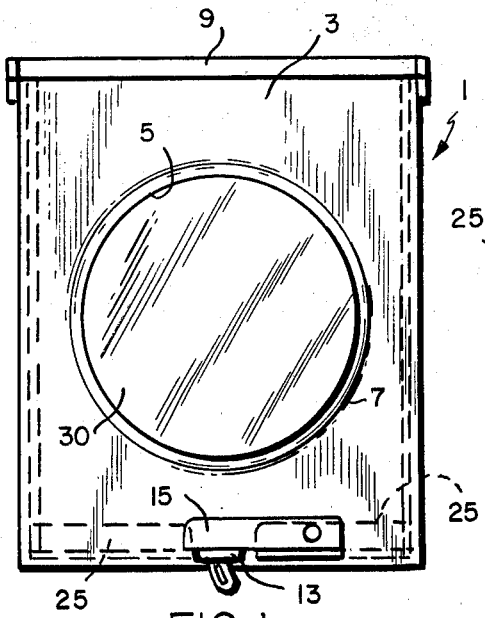
Figure 6:
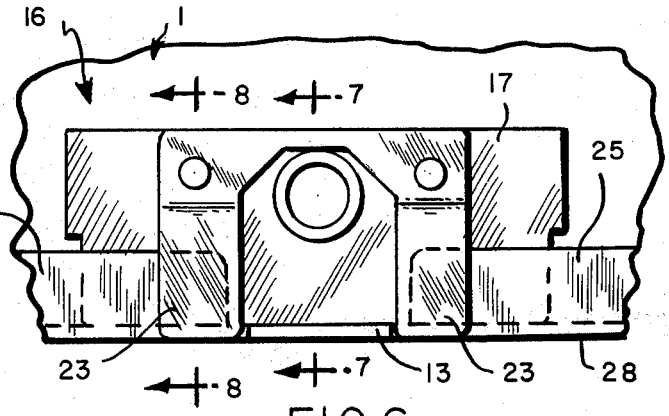
FIG. 6 shows the supporting element clip of FIG. 3 as applied to the inturned flanges of the lower end of the box, at mid-width of the latter.
Figure 2:
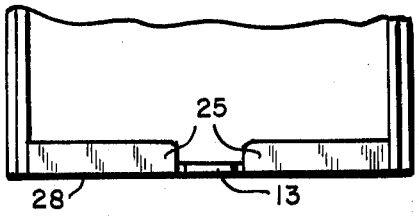
Figure 3:
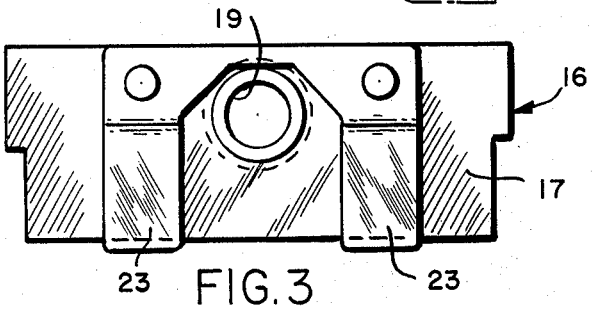
Figure 9:
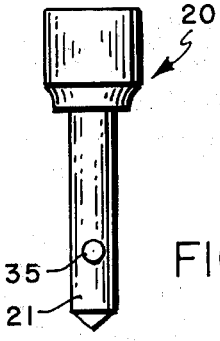
FIG. 9 shows a typical Morse-Nielsen locking bolt as used herein.
Figure 4:
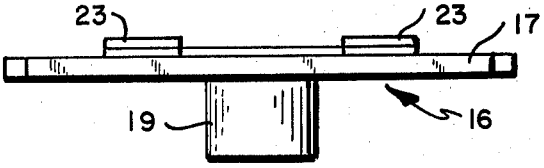
Figure 5:
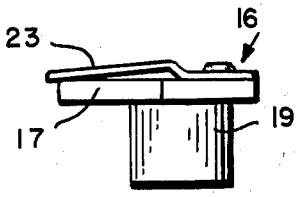
Figure 11:
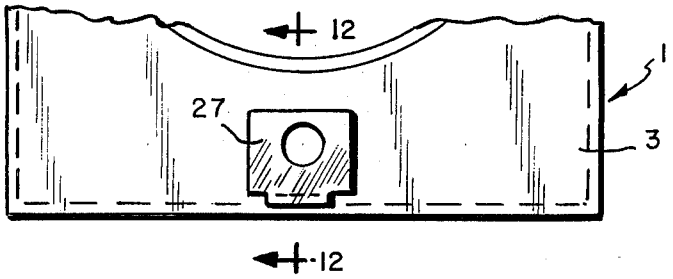
FIGS. 10, 11 and 12 show a template and its use in locating the hole for the locking bolt at mid-width in the cover, to register with the axis of the sleeve when the clip is in position at mid-width of the box.

The novel locking means of FIGS. 1–13 comprises a supporting element clip 16, FIG. 3, having a rigid plate 17 with a guide sleeve 19 fixed thereon and extending perpendicularly therefrom. The guide sleeve forms at its inward end an annular retaining shoulder having an internal diameter fitting easily about the barrel 21 of a bolt type lock 20 of the Morse-Nielsen type or equivalent (as shown in U.S. Pat. Nos. 3,835,674 and 3,714,802). This clip has two spring fingers 23 adapted to clamp the plate 17 tightly against the inward side of the flanges 25 on and extending upward from the lower edge of the box, as shown in FIG. 6. The fingers 23 are spaced to fit against the edges of the tongue 13, and are conveniently made from a piece of spring stock riveted to the plate 17.

Figure 12:
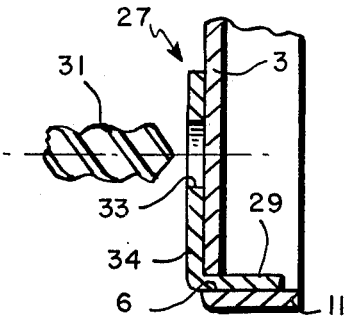
Figure 10:
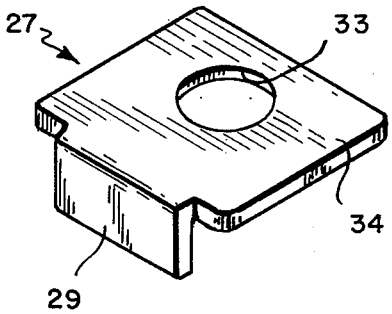

To admit the barrel 21 of the lock 20 to the sleeve 19, a hole is bored through the cover 3, and to align this hole with the passage through the sleeve 19 a locating gauge or template 27, FIG. 10, is used having a tongue 29 fitting the slot 6 and a flange 34 seating against the outer surface of the cover 3, FIG. 12. A screw-driven punch (not shown) or drill 31 of the diameter of the interior of the sleeve 19 is centered in register with the bore of the sleeve by the hole 33 in the flange of this template 27.

Since the clip is positioned in two dimensions by engagement of plate 17 with the inner surface of the lower wall 28 of the box and by the close fit of the fingers 23 against the sides of the tongue 13, while the template is positioned by the tongue 29 in the slot 6 closely fitting the tongue 13, the aligning of the hole in the cover 3 with the sleeve 19 is easily accomplished.

The sleeve 19 is of the proper length such that the locking balls 35 of the bolt type lock 20 will assume their extended locking relation adjacent to the annular retaining shoulder as shown in FIG. 7 when the head of the lock is seated on the outside of the cover and the barrel is fully extended through the sleeve. Thus the cover is locked in immovable relation.

Figure 13:
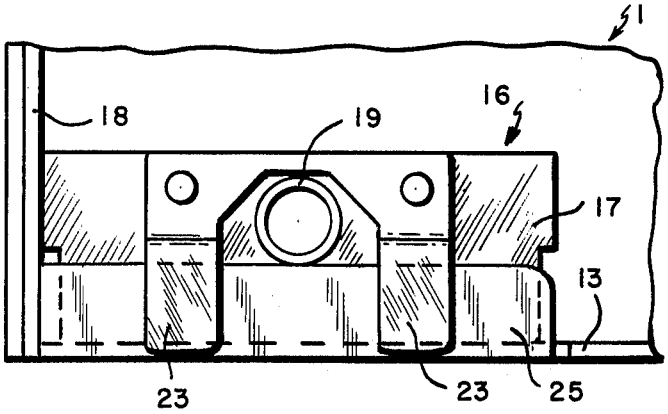
FIG. 13 shows the clip located alternatively at the left-hand corner of the lower end of the box.
Figure 15:
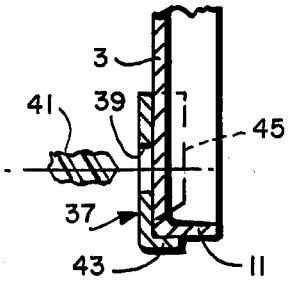
Figure 14:
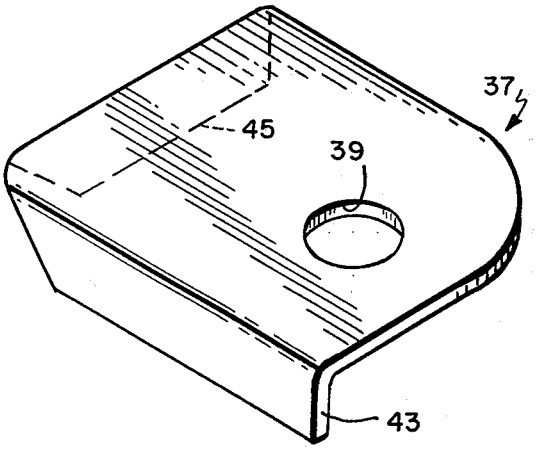
FIG. 14 shows the template used to locate the bolt hole in the cover in register with the clip in FIG. 13.

Alternative locations of the locking bolt and its mating element, the sleeve 19 on the clip 16 when affixed to the body of the box, are provided for by suitable templates. Thus, when the lock is to be located at the left-hand lower corner of the meter box, the clip 16 is affixed to the left-hand flange 25 of the lower wall of the box body with its left-hand end against the inner surface of the box's left-hand wall 18 as shown in FIG. 13, and a template 37, FIG. 14, defining a trihedral angle is fitted over the left-hand lower corner of the cover as in FIG. 16. The guide hole 39 for the drill 41 or punch, FIG. 15, is brought into register with the bore of the sleeve 19 by the engagement of the flange 43 with the lower flange 11 of the cover and the flange 45 with the left-hand lateral flange of the cover 3. A bolt lock inserted through the hole thus located in the cover and aligned sleeve 19 makes the meter lid secure against wrongful opening. The clip is of course removed during the drilling of the cover.

Location of the lock at any desired point across the lower end of the box will be effected in obvious manner by suitable modification of the template used, as by reversing the "hand" of the latter for bolting the right-hand corner of the cover.

To adapt the invention to meter boxes lacking the inturned flange utilized in the manner just described, a substitute flange in the form of a bracket 49 shown in FIG. 17 is used as indicated in FIGS. 18 and 19, to provide an element on the box body having an aperture mating with the barrel of the bolt type lock. Thus, the right-angled bracket 49 with a sleeve 51 fixed therein and mating with the barrel 53 of a bolt type lock 55, FIG. 19, put through a hole 57 formed therefor in the cover 3, is affixed to the lower wall 59, as in FIG. 18, by a round-headed bolt 61 having a squared shank 63 fitting a square hole 65 in flange 67 of the bracket 49. The square shank in matching hole 65 holds the bolt from being turned from outside the box, in an effort to open the cover. The location of the hole 69 for bolt 61 is determined by use of a template 71, FIGS. 20 and 21, with its inturned flange 73 hooked over the edge of the lower end 59 of the box and bearing against the inner wall of the side 18. Hole 75 guides the drill or punch 77.

To locate the hole 57 in the cove in register with the sleeve 51 when the cover is closed, a trihedral template, similar in construction and use to 37 of FIG. 16, is employed.

As is clear in FIG. 19, the cover 3 cannot be opened so long as the bolt lock 55 extends through the cover and the sleeve 51 with the locking balls 81 extended.

It will be seen that the sleeve 19 or 51 extends axially of the barrel 21 or 53 of the lock 20 or 55 mainly to confer strength and stability to the structure. A simple hole through the clip 16 or the bracket 49 fitting the barrel 21 or 53 would lock the cover in closed relation, but would require redesign of the standard bolt lock to shorten the spacing of the locking balls from the cover-engaging shoulder of the head of the lock, in the clip form, or else a spaced relation between the proximate face of the bracket and the cover in closed relation which would render it harder to enter the barrel in the hole, sight unseen.

While we have illustrated and described certain forms in which the invention may be embodied, we are aware that many modifications may be made therein by any person skilled in the art, without departing from the scope of the invention as expressed in the claims.

Therefore, we do not wish to be limited to the particular forms shown, or to the details of construction thereof, but What we do claim is:

1. A locking adaptor assembly for securing the flat apertured cover firmly against a flange of the hollow body of a receptacle for a wattmeter or the like by use of a completely removable bolt type lock having a cylindrical barrel with locking balls extending laterally near one end of the barrel and with an enlarged head permanently fixed at the other end of the barrel, said locking adaptor assembly comprising:

a. a supporting element detachably mounted within the hollow body of the receptacle, said supporting element having at least one resilient mounting finger for gripping the flange of the hollow receptacle body;

b. said supporting element having an annular retaining shoulder positioned within the hollow body of the receptacle, said retaining shoulder having an inner diameter which is smaller than the diameter of the lock barrel with locking balls extended and which is larger than the diameter of the lock barrel with locking balls retracted; and c. said annular retaining shoulder being axially aligned with the aperture of the closed cover and being spaced inwardly from the closed cover by a distance sufficient to enable the bolt type lock to maintain the cover firmly closed.

2. The assembly of claim 1 further having a guide sleeve mounted on the receptacle, said guide sleeve having an inner diameter which is substantially equal to that of said retaining shoulder, said guide sleeve being axially aligned with the aperture of the closed cover and with said retaining shoulder, and being positioned outwardly from said retaining shoulder.

3. The assembly of claim 2 wherein said guide sleeve extends at least partly within the hollow body of the closed receptacle.

4. The assembly of claim 2 wherein said guide sleeve is located entirely within the hollow body of the closed receptacle.

5. The assembly of claim 2 wherein said guide sleeve is attached to said supporting element.

6. The assembly of claim 5 wherein said annular retaining shoulder is formed by said guide sleeve.

7. The assembly of claim 6 wherein said annular retaining shoulder is formed by the inner end of said guide sleeve.

8. The assembly of claim 7 wherein the outer end of said guide sleeve is substantially flush with the inner surface of the closed receptacle cover.

9. The assembly of claim 8 wherein said supporting element has two resilient mounting fingers for gripping the flange of the hollow receptacle body.

* * * * *